US006854868B2

(12) United States Patent
Wu

(10) Patent No.: US 6,854,868 B2
(45) Date of Patent: Feb. 15, 2005

(54) DECORATION FIXTURE OF CEILING LAMP

(76) Inventor: Wen-Chang Wu, No. 10, Lane 191, Hsi Hsin Street, Chuang Ya Tsun, Hsiu Shui Hsiang, Chang Hua Hsien (TW)

( * ) Notice: Subject to any disclaimer, the term of this patent is extended or adjusted under 35 U.S.C. 154(b) by 0 days.

(21) Appl. No.: 10/369,653

(22) Filed: Feb. 21, 2003

(65) Prior Publication Data

US 2004/0165376 A1 Aug. 26, 2004

(51) Int. Cl.[7] ..... F21S 8/06
(52) U.S. Cl. ..... 362/405; 362/433
(58) Field of Search ..... 362/404, 405, 362/433, 408, 806; D26/81, 84, 86, 154, 155

(56) References Cited

U.S. PATENT DOCUMENTS 5,109,325 A * 4/1992 Bayer et al. ..... 362/433
5,906,430 A * 5/1999 Bayer ..... 362/404
6,241,370 B1 * 6/2001 Bayer et al. ..... 362/405
2002/0154507 A1 * 10/2002 Bayer ..... 362/405

* cited by examiner

*Primary Examiner*—Y. My Quach-Lee
*Assistant Examiner*—Peggy A. Neils
(74) *Attorney, Agent, or Firm*—Troxell Law Office, PLLC

(57) ABSTRACT

The present invention discloses an improved decoration fixture of a ceiling lamp, which can fix a decoration around the external periphery of a lamp rod of a ceiling lamp, comprising a restricting bar installed on the lamp rod in advance, and a decoration tied to the restricting bar; wherein the restricting bar attaches onto the external periphery of the lamp rod along the curvature of the lamp rod, and has a protruded latch disposed at every interval of appropriate length such that the protruded latch can appropriately fix the decoration into a position. A tying string passes through the protruded latch of the restricting bar and ties a decoration on the string to position the decoration on the external periphery of the lamp rod. Since after the string tying the decoration passes through the protruded latch of the restricting bar, the string is tied directly on the protruded latch of the restricting bar such that the string will not tangle with the lamp rod, or affect the external look of the overall lamp rod.

1 Claim, 5 Drawing Sheets

DECORATION FIXTURE OF CEILING LAMP

BACKGROUND OF THE INVENTION

1. Field of the Invention

The present invention relates to a decoration fixture of ceiling lamp, more particularly to an improved decoration fixture of ceiling lamp that fixes the decoration onto the ceiling lamp without affecting the external look of the overall lamp rod.

2. Description of the Related Art

Please refer to FIG. 1A and 1B for a prior-art decoration fixture of a ceiling lamp, which attaches a decoration 3 onto a lamp rod 1 according to the curvature of the lamp rod 1, and after a string 4 ties the decoration 3 onto the periphery of the lamp rod 1, the decoration 3 is fixed onto the lamp rod 1 to accomplish the purpose of decorating the lamp rod 1.

However, after the string 4 passes through the wire 31 of the decoration 3, the decoration 3 is tied onto the body of the lamp rod 1 directly, and such string will be exposed and seen around the periphery of the lamp rod 1 which affects the artistic look of the lamp rod 1. In view of the above shortcomings, the inventor studied and researched this subject and finally invented the present invention.

SUMMARY OF THE INVENTION

The primary objective of this invention is to provide an improved decorative fixture of a ceiling lamps, which can fix a decoration around the external periphery of a lamp rod of a ceiling lamp, comprising a restricting bar installed on a lamp rod in advance, and a decoration tied to the restricting bar; wherein the restricting bar attaches onto the external periphery of the lamp rod according to the curvature of the lamp rod, and has a protruded latch disposed at every interval of appropriate length such that the protruded latch can appropriately fix the decoration into a position. A tying string passes through the protruded latch of the restricting bar and ties a decoration on the string to position the decoration on the external periphery of the lamp rod. Since after the string tying the decoration passes through the protruded latch of the restricting bar, the string is tied directly on the protruded latch of the restricting bar such that the string will not tangle to the lamp rod, or affect the external look of the overall lamp rod.

To make it easier for our examiner to understand the objective of the invention, its structure, innovative features, and performance, we use a preferred embodiment together with the attached drawings for the detailed description of the invention.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1B:
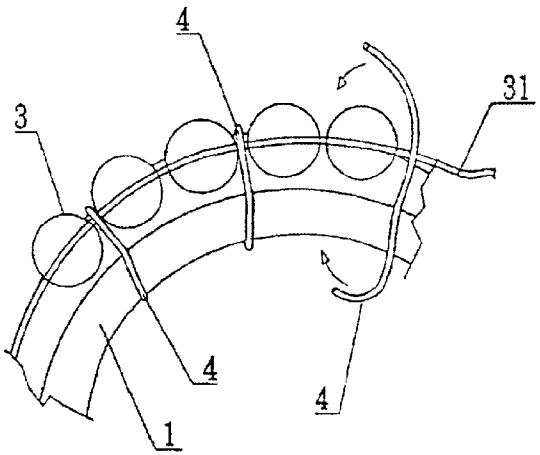
FIG. 1B Prior Art
FIG. 1B is a diagram of the external look of the decoration being tied to a lamp rod according to the prior art.
Figure 1A:
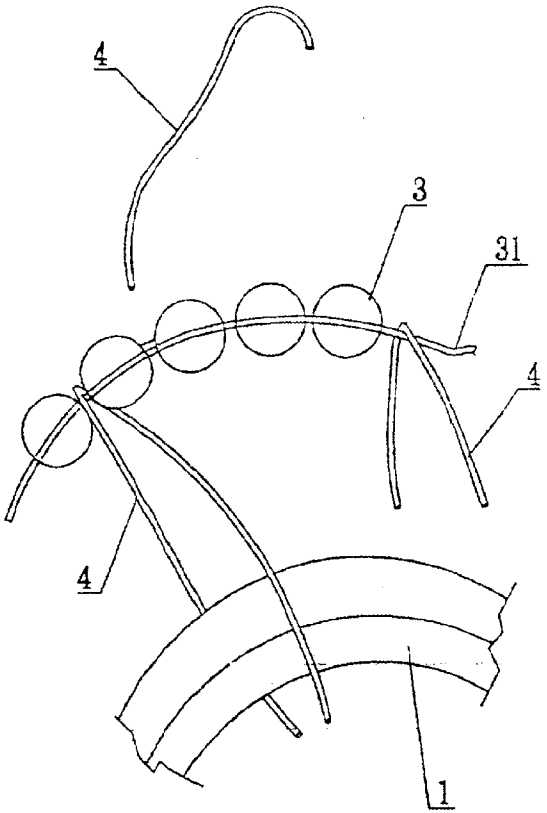
FIG. 1A Prior Art
FIG. 1A is a diagram illustrating the actions of tying a decoration to a lamp rod according to the prior art.

In the detailed description of the preferred embodiments, it should be noted that like elements are indicated by the same reference numerals throughout the disclosure.

Figure 2:
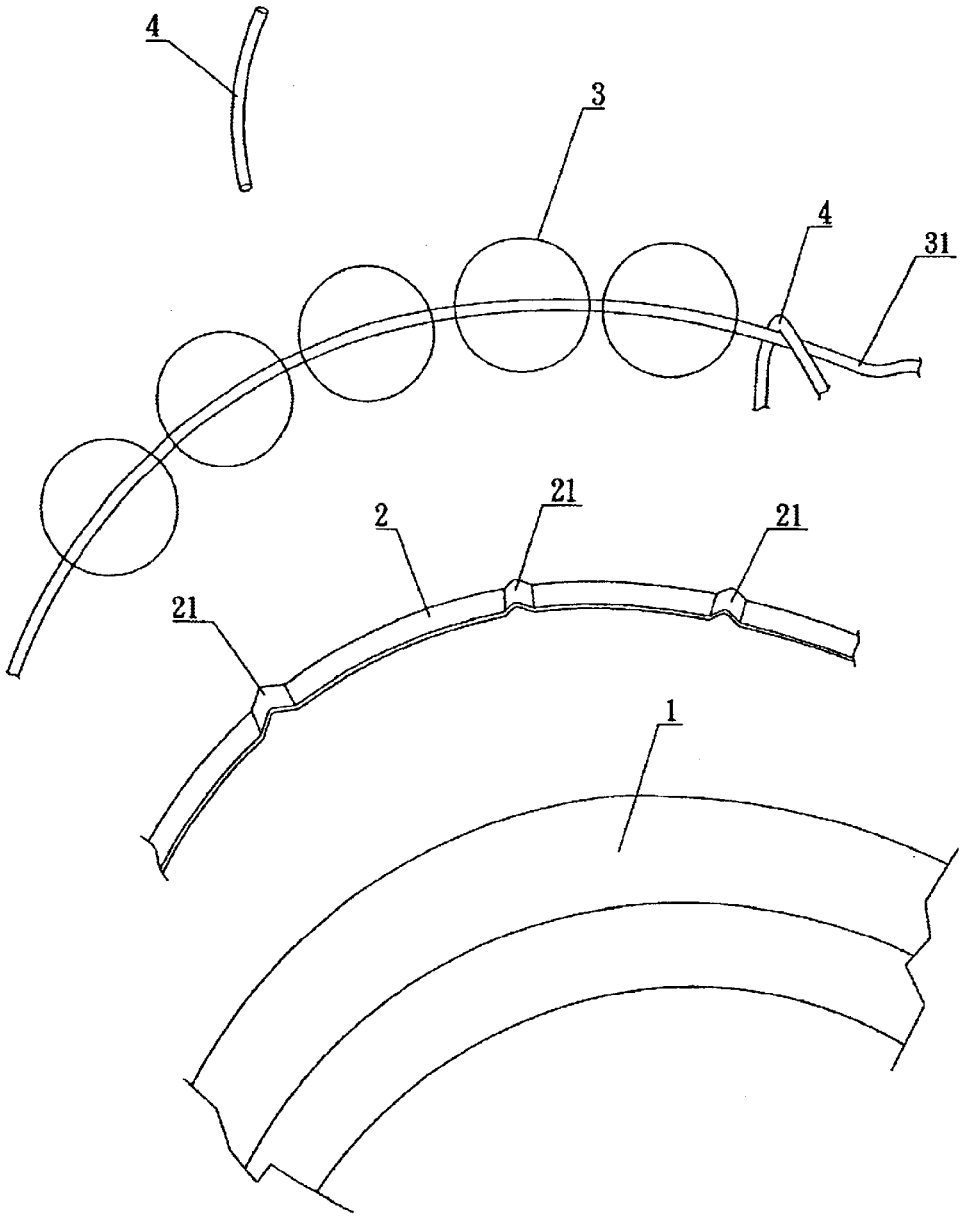
FIG. 2 is a diagram of the disassembled parts of the present invention.
Figure 3:
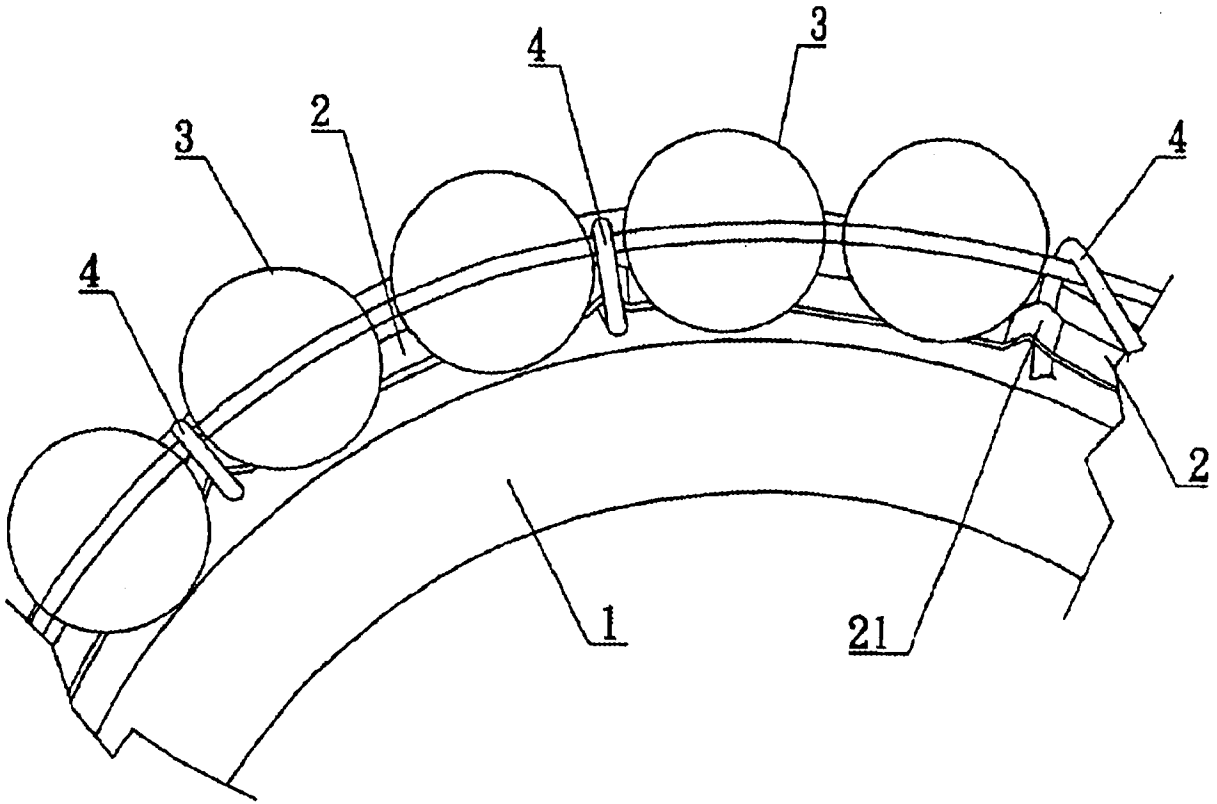
FIG. 3 is a diagram of the external look of the decoration being tied to a lamp rod according to the present invention.
Figure 4:
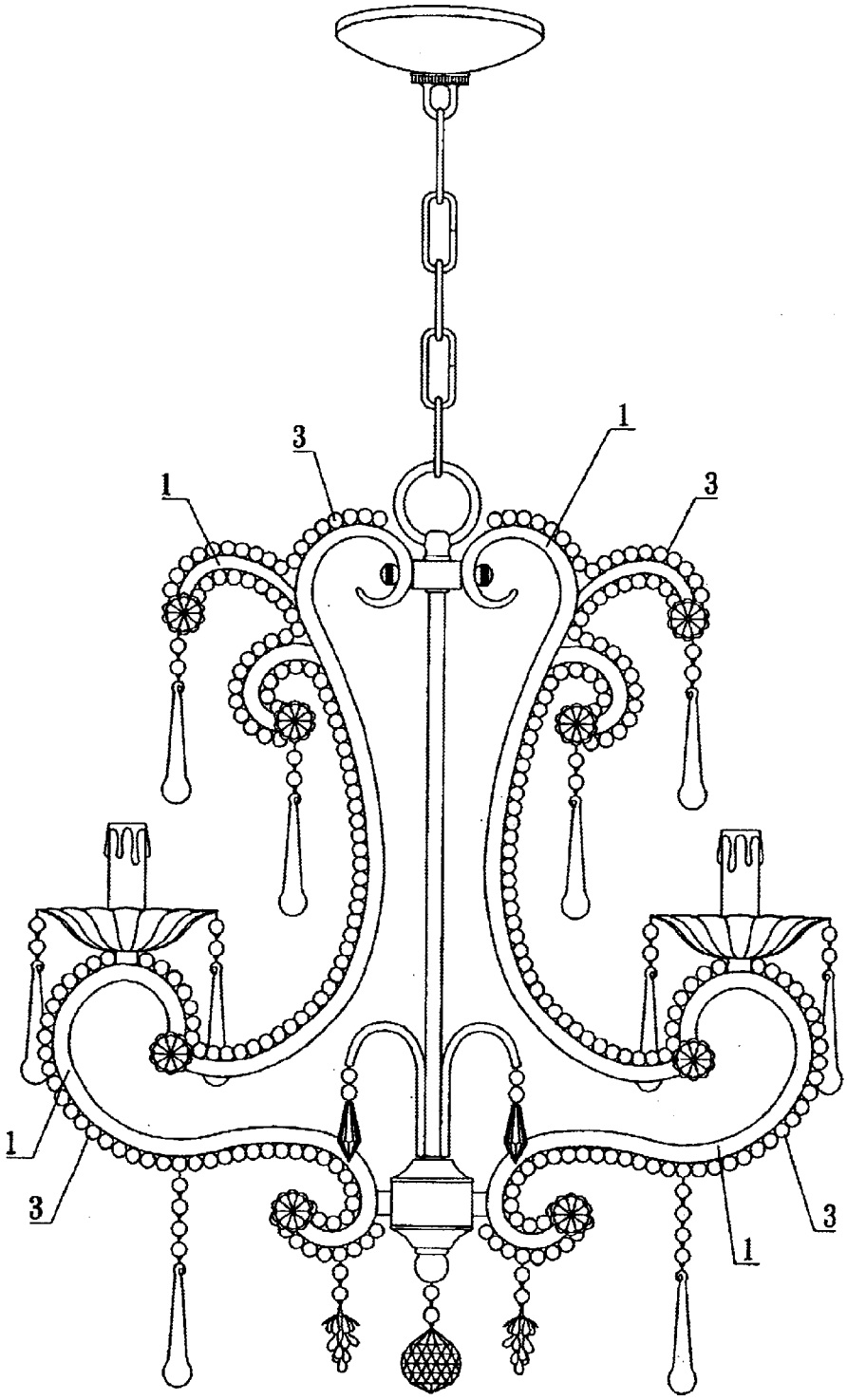
FIG. 4 is a diagram of the external look of the lamp rod according to the present invention.

Refer to FIGS. 2–4 for the structure of the present invention. The present invention is a utility model capable of fixing a decoration onto the periphery of a lamp rod by installing a restricting bar 2 on a lamp rod 1 in advance, and then tying a decoration 3 onto the restricting bar 2; wherein said restricting bar 2 attaches onto the external periphery of the lamp rod I along the curvature of the lamp rod 1, and has a protruded latch 21 disposed at every interval of appropriate length of the restricting bar 2 such that the protruded latch 21 can appropriately fix the decoration 3 into a position. A tying string 4 passes through the protruded latch 21 of the restricting bar 2 and ties a decoration 3 on the wire 31 to position the decoration 3 on the external periphery of the lamp rod 1 to accomplish the purpose of decorating the lamp rod. 1.

Figures 5, 5A:
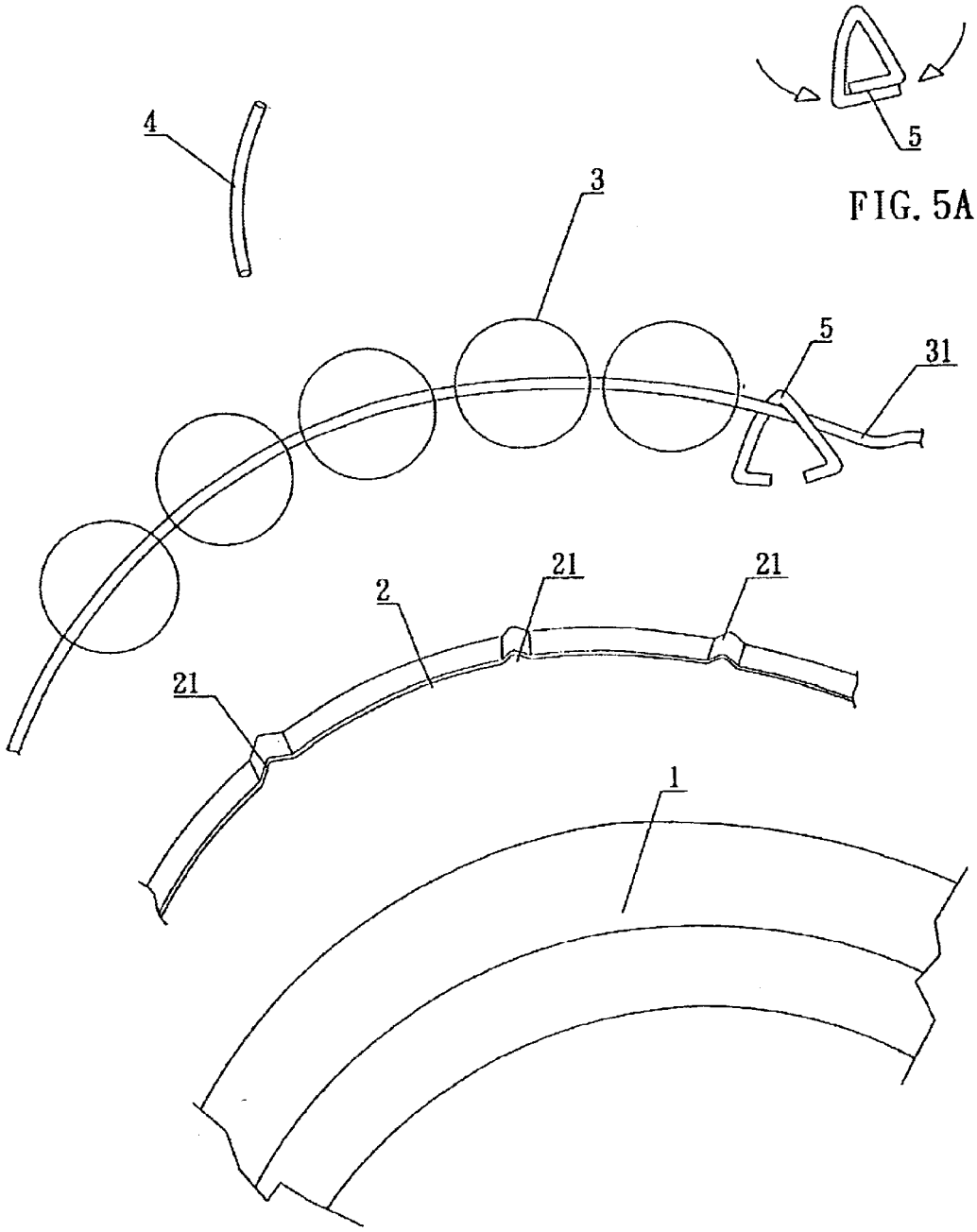
FIG. 5 is a diagram of another embodiment of the present invention.
FIG. 5A is a diagram showing the double-sided clipping situation of the fixing clip of the present invention.

Refer to FIGS. 5 and 5A. A fixing clip 5 passes through the wire 31 of the decoration 3 and the protruded latch 21 of the restricting bar 2 and clips them together with the from force from both sides inward so that the ends of the fixing clip 5 are engaged to clip the decoration 3 and the restricting bar 2 in a fixed position.

Since after the string tying the decoration passes through the protruded latch of the restricting bar, the string is tied directly on the protruded latch of the restricting bar and will not tangle to the lamp rod, or affect the external look of the overall lamp rod.

In summation of the above description, the structure of the improved decoration fixture of ceiling lamp disclosed by the present invention is novel, and definitely can accomplish the function as described above, herein complies with the patent application requirements, and is submitted to the Patent and Trademark Office for review and granting of the commensurate patent rights.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. An improved decoration fixture of a ceiling lamp comprising:

a restricting bar installed onto a lamp rod, and a decoration tied onto the restricting bar; wherein:

said restricting bar is attached onto an external periphery of said lamp rod along a curvature of said lamp rod, and has a protruded latch located such that said protruded latch holds the decoration in a pre-determined position;

a tying string passing through said protruded latch of said restricting bar and tying the decoration on said string to position the decoration on the external periphery of said lamp rod, such that when the decoration is tied to the protruded latch of the restricting bar, the string is tied directly on the protruded latch of the restricting bar without being tied to the lamp rod, wherein said protruded latch of the restricting bar and a wire of the decoration pass through a clip, and said clip is clipped inward from both sides such that both ends of the clip are engaged.

* * * * *